US007151430B2

(12) United States Patent
Mattsson

(10) Patent No.: US 7,151,430 B2
(45) Date of Patent: Dec. 19, 2006

(54) METHOD OF AND INDUCTOR LAYOUT FOR REDUCED VCO COUPLING

(75) Inventor: Thomas Mattsson, Limhamn (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 170 days.

(21) Appl. No.: 10/919,130

(22) Filed: Aug. 16, 2004

(65) Prior Publication Data

US 2005/0195063 A1 Sep. 8, 2005

Related U.S. Application Data

(60) Provisional application No. 60/565,328, filed on Apr. 26, 2004, provisional application No. 60/549,611, filed on Mar. 3, 2004.

(51) Int. Cl.
*H01F 5/00* (2006.01)

(52) U.S. Cl. ..... 336/200; 336/232

(58) Field of Classification Search ..... 336/223, 336/226, 200, 232

See application file for complete search history.

(56) References Cited

U.S. PATENT DOCUMENTS

| | | | | |
|---|---|---|---|---|
| 5,831,331 | A * | 11/1998 | Lee | 257/659 |
| 6,194,987 | B1 * | 2/2001 | Zhou et al. | 336/200 |
| 6,268,778 | B1 | 7/2001 | Mucke et al. | |
| 6,512,422 | B1 | 1/2003 | Dufour et al. | |
| 6,529,720 | B1 | 3/2003 | Jovenin et al. | |
| 6,664,606 | B1 | 12/2003 | Estes | |
| 6,891,444 | B1 * | 5/2005 | Jacobsson et al. | 331/117 R |
| 6,894,598 | B1 * | 5/2005 | Heima | 336/200 |
| 6,974,740 | B1 * | 12/2005 | Lowther et al. | 438/214 |
| 2003/0155630 | A1 | 8/2003 | Woo | |
| 2003/0186674 | A1 | 10/2003 | Keeney et al. | |
| 2003/0202331 | A1 * | 10/2003 | Jessie et al. | 361/764 |

FOREIGN PATENT DOCUMENTS

| | | |
|---|---|---|
| WO | WO 98/05048 A | 2/1998 |
| WO | WO-03/084295 | 10/2003 |
| WO | WO 2004/012213 A | 2/2004 |

OTHER PUBLICATIONS

European Patent Office: International Search Report for PCT/EP2005/001515 dated Jun. 1, 2005.

* cited by examiner

*Primary Examiner*—Anh Mai

(57) ABSTRACT

Method and system are disclosed for reducing mutual EM coupling between VCO resonators and for implementing the same on a single semiconductor chip. The method and system involve using inductors that are substantially symmetrical about their horizontal and/or their vertical axes and providing current to the inductors in a way so that the resulting magnetic field components tend to cancel each other by virtue of the symmetry. In addition, two such inductors may be placed near each other and oriented in a way so that the induced current in the second inductor due to the magnetic field originating from first inductor is significantly reduced. The inductors may be 8-shaped, four-leaf clover-shaped, single-turn, multi-turn, rotated relative to one another, and/or vertically offset relative to one another. This Abstract is submitted with the understanding that it will not be used to interpret or limit the scope or meaning of the claims. 37 CFR 1.72(b).

21 Claims, 6 Drawing Sheets

METHOD OF AND INDUCTOR LAYOUT FOR REDUCED VCO COUPLING

CROSS-REFERENCE TO RELATED APPLICATIONS

This application claims priority from, and hereby incorporates by reference the entire disclosure of, U.S. Provisional Application No. 60/549,611, bearing, entitled "Inductor Design for Reduced VCO Coupling", and filed on Mar. 3, 2004.

This application claims priority from U.S. Provisional Application No. 60/565,328, bearing, 01, entitled "Inductor Design for Reduced VCO Coupling", and filed on Apr. 26, 2004.

FIELD OF THE INVENTION

The present invention relates to voltage-controlled oscillators (VCO) of the type used in radio frequency (RF) transceivers and, in particular, to an improved inductor design in a VCO.

BACKGROUND OF THE INVENTION

Recent advances in wireless communication technology have allowed an entire RF transceiver to be implemented on a single semiconductor die or chip. However, integrating a complete RF transceiver on a single chip presents a number of challenges. For example, in wideband code division multiple access (WCDMA) transceivers, a single-chip solution requires two RF VCOs to be running on the chip at the same time. Such an arrangement may produce undesired interaction between the two VCOs due to various types of mutual coupling mechanisms, which may result in spurious receiver responses and unwanted frequencies in the transmit spectrum. The primary mutual coupling mechanism is usually the fundamental electromagnetic (EM) coupling between the resonators, i.e., the large inductor structures in the VCOs.

A number of techniques exist for reducing the mutual EM coupling between the VCOs due to the inductors. One technique involves reduction of EM coupling by careful design of the inductors to provide maximum isolation of the inductors. Another techniques calls for frequency separation by operating the two VCOs at different even harmonics of the desired frequency. Still another technique involves frequency separation by using a regenerative VCO concept. The frequency separation methods exploit the filtering properties of the resonator to reduce interference. However, these solutions require additional circuitry (dividers, mixers, etc.) that may increase current consumption, making them less attractive than other mutual EM coupling reduction alternatives.

SUMMARY OF THE INVENTION

An inductor design for reducing mutual EM coupling between VCO resonators and a method of implementing the same on a single semiconductor chip. A method and system involve using inductors that are substantially symmetrical about their horizontal and/or their vertical axes and providing current to the inductors in a way so that the resulting magnetic field components tend to cancel each other by virtue of the symmetry. In addition, two such inductors may be placed near each other and oriented in a way so that the induced current in the second inductor due to the magnetic field originating from first inductor is significantly reduced. The inductors may be 8-shaped, four-leaf clover-shaped, single-turn, multi-turn, rotated relative to one another, and/or vertically offset relative to one another.

In general, in one aspect, an inductor having a reduced far field comprises a first loop having a shape that is substantially symmetrical about a first predefined axis, and a second loop having a size and shape substantially identical to a size and shape of the first loop. The second loop is arranged such that a magnetic field emanating therefrom tends to cancel a magnetic field emanating from the first loop.

In general, in another aspect, a method of reducing mutual electromagnetic coupling between two inductors on a semiconductor die comprises the step of forming a first inductor on the semiconductor die having a shape that is substantially symmetrical about a first predefined axis, the shape causing the first inductor to have a reduced far field, at least in some directions. The method further comprises the step of forming a second inductor on the semiconductor die at a predetermined distance from the first inductor, wherein a mutual electromagnetic coupling between the first inductor and the second inductor is reduced as a result of the first inductor having a reduced far field.

In general, in another aspect, an inductor layout having reduced mutual electromagnetic coupling comprises a first inductor having a shape that is substantially symmetrical about a first predefined axis, the shape causing the first inductor to have a reduced electromagnetic field at a certain distance from the first inductor, at least in some directions. The inductor layout further comprises a second inductor positioned at a predetermined distance from the first inductor, wherein a mutual electromagnetic coupling between the first inductor and the second inductor is reduced as a result of the first inductor having a reduced electromagnetic field.

It should be emphasized that the term comprises/comprising, when used in this specification, is taken to specify the presence of stated features, integers, steps, or components, but does not preclude the presence or addition of one or more other features, integers, steps, components, or groups thereof.

BRIEF DESCRIPTION OF THE DRAWINGS

The foregoing and other advantages of the invention will become apparent from the following detailed description and upon reference to the drawings, wherein.

DESCRIPTION OF ILLUSTRATIVE EMBODIMENTS OF THE INVENTION

As mentioned above, various embodiments of the invention provide an inductor design and method of implementing the same where mutual EM coupling is reduced. The inductor design and method serve to reduce the EM field at a certain distance from the inductor (i.e., the far field), at least in some directions, by using inductor shapes that are substantially symmetrical. As used herein, the term "symmetrical" refers to symmetry relative to at least one axis. This reduced far field may then be used to reduce the mutual coupling between two inductors. The inductor design and method may also be used to reduce the coupling between an inductor and another on-chip or external structure (e.g., an external power amplifier). This helps reduces the sensitivity of the VCO to interfering signals from other than a second on-chip VCO.

Figure 8:
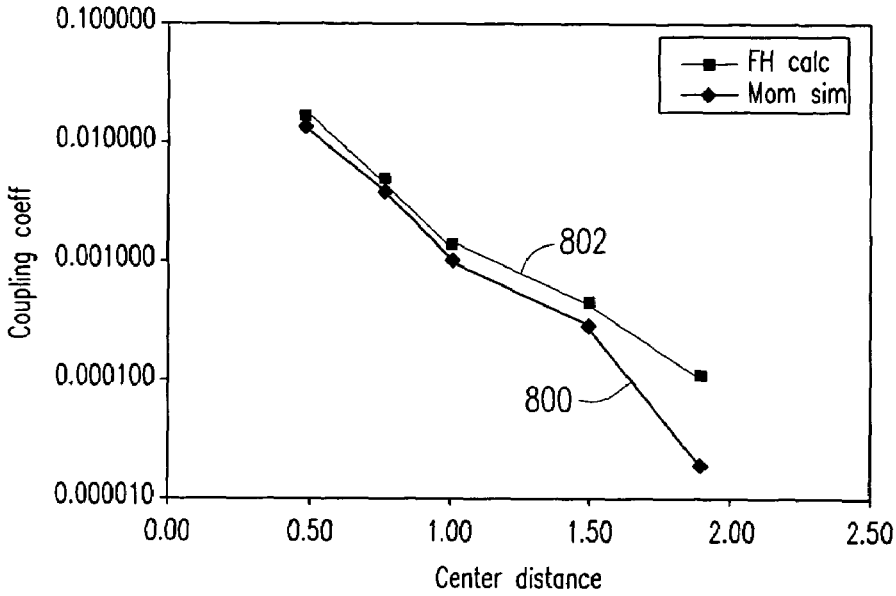
FIG. 8 illustrates the impact of distance on the coupling coefficient using the inductor arrangements.

Choosing a substantially symmetrical shape (e.g., a figure-8 or a four-leaf clover shape) for the first inductor helps reduce the EM field at far distances. This will, in turn, reduce mutual EM coupling to the second inductor, regardless of its shape. If the second inductor also has a similar or substantially identical shape, the tendency of the second inductor to pick up the EM field from the first inductor is also reduced via the same mechanisms. Thus, the overall isolation between the two inductors is further improved. Note, however, that the two inductors need not have the same size or the same shape as long as they have a substantially symmetrical shape. To the extent identical inductor layouts are shown in the figures, it is for illustrative purposes only.

Further, although various embodiments of the invention are described herein mainly with respect to VCO-related isolation issues, RF amplifiers and mixers with tuned LC loads or inductive degeneration may also couple to each other or to a VCO and create interference problems. Thus, a person having ordinary skill in the art will appreciate that the inductor design and method may be used to reduce coupling between two functional blocks of any type so long as each contains one or more inductors.

In order to reduce EM coupling between two inductors, it is typically necessary to reduce the far field generated by the inductor coils. Unfortunately, this is not a simple task because there are many topological constraints on a planar integrated inductor. For example, a typical inductor design uses two or more stacked metal layers. Normally the top layer is much thicker (i.e., has lower resistance) than the other layers. It is therefore desirable to mainly use this layer in order to achieve a maximum Q-factor. Where the wires are crossing, thinner metal layers are usually used and careful design of the crossings is needed to combine high Q-factor with minimum coupling. Further, negative electromagnetic coupling between parallel wire segments close to each other should be avoided so that the inductance per wire length unit is maximized. However, by exploiting the symmetry of the inductor in one or more dimensions together with controlling the EM field components emanating from different parts of the inductor coil, the far field may be reduced in some directions due to canceling effects.

Figure 1:
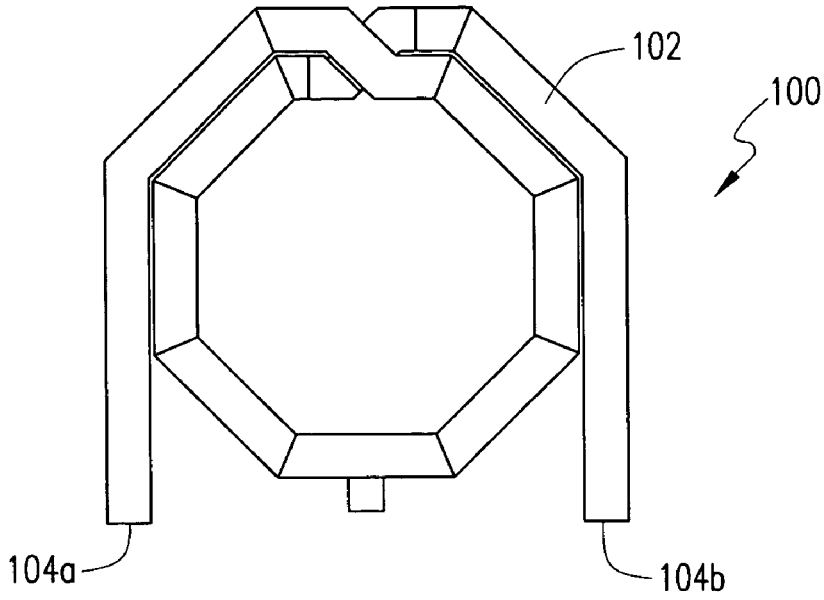
FIG. 1 (PRIOR ART)
FIG. 1 illustrates a prior art O-shaped inductor.

Existing VCO inductor designs are optimized for maximum Q-factor given the constraints regarding silicon area, wire width, and the like. FIG. 1 shows an example of an existing inductor 100 commonly used in RF VCOs. The inductor 100 is a differential 1.25 nH inductor with an inductor coil 102 having two terminals 104. As can be seen, the positions of the terminals 104*a* and 104*b* have been optimized for connection to the rest of the VCO, including any varactors and MOS switches (not shown) that may be present, but little attention was paid to mutual EM coupling apart from keeping a certain minimum distance from other metal wires in the vicinity.

Figure 2:
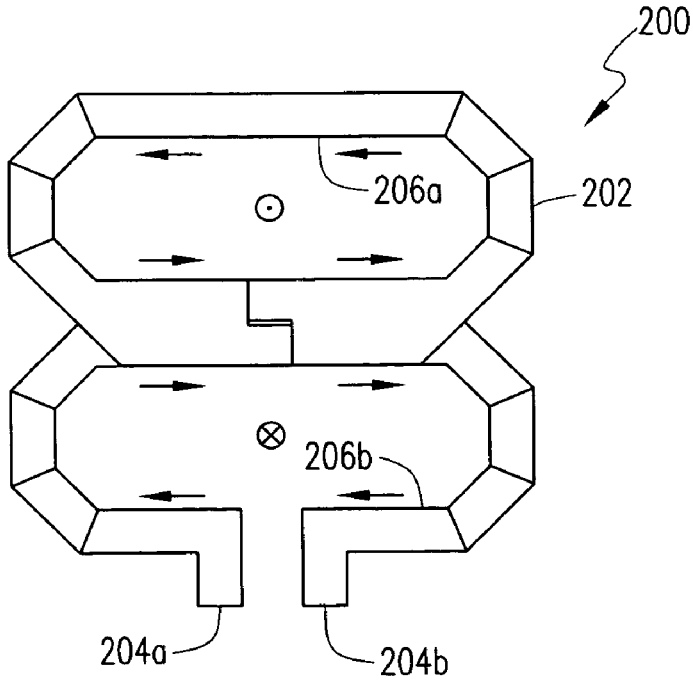
FIG. 2 illustrates an 8-shaped inductor.

FIG. 2 shows an example of an inductor 200. The inductor 200 has an inductor coil 202 and terminals 204*a* and 204*b*, and has been designed so that it is substantially symmetrical about a horizontal axis X. In the present example, the inductor coil 202 is in the form of a single-turn 8-shaped structure with an upper loop 206*a* and a lower loop 206*b*. By virtue of the figure-8 shape, current in the upper loop 206*a* travels in a direction (e.g., counterclockwise, see arrows) that is opposite to current in the lower loop 206*b* (e.g., clockwise). As a result, the EM field components emanating at a certain distance from the two substantially symmetrical loops 206*a* and 206*b* also have opposite directions and tend to counteract each other. The directions of the EM field components are indicated by conventional notation in the middle of each loop 206*a* and 206*b*. Consequently, the inductor 200 has been found to have a significantly reduced far field at a certain distance from the inductor coil 202. Thus, by making the two loops 206*a* and 206*b* substantially symmetrical, cancellation of a significant amount of far field on either side of the horizontal symmetry axis X may be achieved. It should be noted, however, that perfect symmetry between the two loops 206*a* and 206*b* may be difficult to achieve given the presence of the terminals 204*a* and 204*b*.

In addition, the positioning of the terminals 204*a* and 204*b* may help minimize the far field. For example, positioning the two terminals 204*a* and 204*b* as close to each other as possible helps make the field contributions from the two parts of the inductor 200 identical. It is also desirable to minimize the additional loop external to the inductor 200 created by the connections to the varactors and switches. This extra loop may compromise the symmetry of the inductor itself to some extent and may reduce the canceling effect. In theory, it should be possible to modify the geometry of the inductor (e.g., make the upper loop slightly larger) to compensate for this effect. The symmetry of the inductor 200 with respect to a center vertical axis is also important for minimizing the generation of common-mode signal components.

Other considerations may include basic layout parameters, such as the width and height of the inductor coil 202 together with the width and spacing of the surrounding metal wires. These parameters, however, are mainly determined by requirements on inductance, Q-factor, chip area, and process layout rules and have only minor influence on mutual coupling characteristics as long as symmetry of the inductor coil is maintained.

Figure 3:
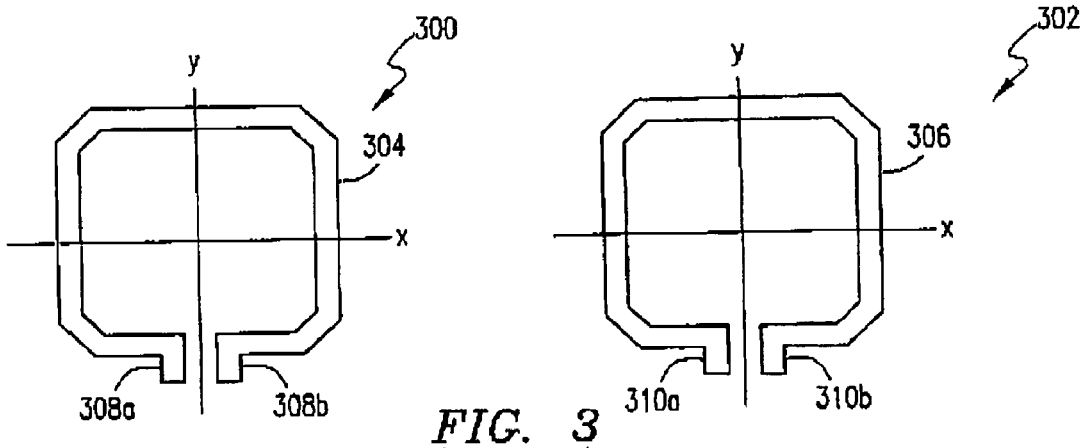
FIG. 3 (PRIOR ART)
FIG. 3 illustrates a prior art O-shaped inductor arrangement.

FIG. 3 illustrates a prior art inductor arrangement of two O-shaped inductors 300 and 302. The two inductors 300 and 302 are placed side-by-side and have O-shaped inductor coils 304 and 306. The inductors coils 304 and 306 in this embodiment are substantially the same size as the 8-shaped inductor coil (e.g., 350×350 μm) of FIG. 2 and are symmetrical relative to their vertical axes Y. The terminals for the two inductor coils 304 and 306 are labeled as 308*a* & 308*b* and 310*a* & 310*b*, respectively. Because each O-shaped inductor 300 and 302 provides little or no EM reduction individually, the arrangement as a whole provides little or no mutual EM coupling reduction.

Figure 4:
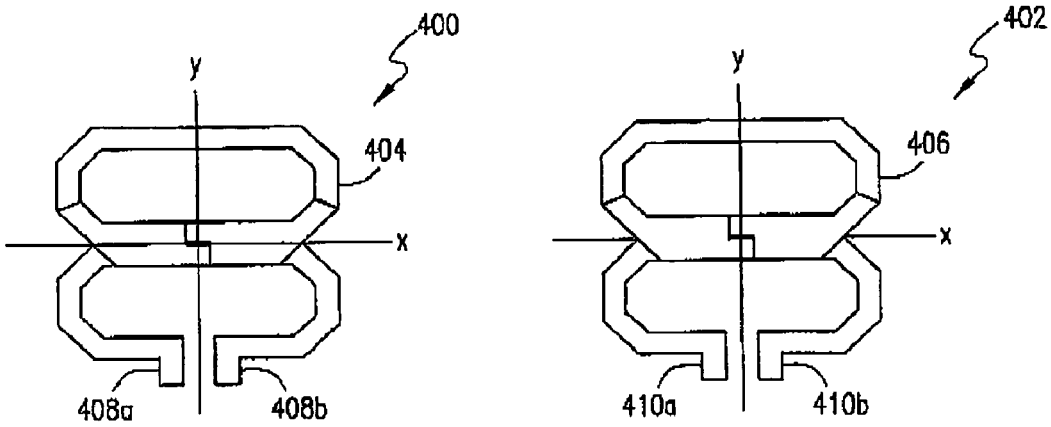
FIG. 4 illustrates an 8-shaped inductor arrangement.

On the other hand, an inductor arrangement involving two 8-shaped inductors like the one in FIG. 2 may provide further reduced mutual EM coupling. This is illustrated in FIG. 4, where an inductor arrangement similar to the arrangement in FIG. 3 is shown, except the two inductors

400 and 402 have 8-shaped inductor coils 404 and 406 instead of O-shaped inductor coils. The terminals for the inductor coils 404 and 406 are labeled as 408*a* & 408*b* and 410*a* & 410*b*, respectively. Each individual inductor 400 and 402 has a reduced far field by virtue of the 8-shaped inductor coil 404 and 406, as explained above with respect to FIG. 2. In addition, there is also a reduction in the mutual coupling between the two inductors 400 and 402. This is because the same mechanism that causes the radiated EM field from the first inductor to be reduced also causes the "EM field receive sensitivity" of the second inductor to be reduced. Thus, the combined effect of the two inductors upon each other provides the desired coupling reduction.

Note that it is not necessary for the two inductors 400 and 402 to have the same size. All that is needed for mutual EM coupling reduction is for them to have similar, EM reducing shapes. Further, a combination of an O-shaped inductor and an 8-shaped inductor may still result in mutual coupling reduction. However, since such an arrangement only uses the EM canceling effect of one inductor (the O-shaped inductor has little or no EM cancellation), the total isolation between the two inductors is less.

Figure 5:
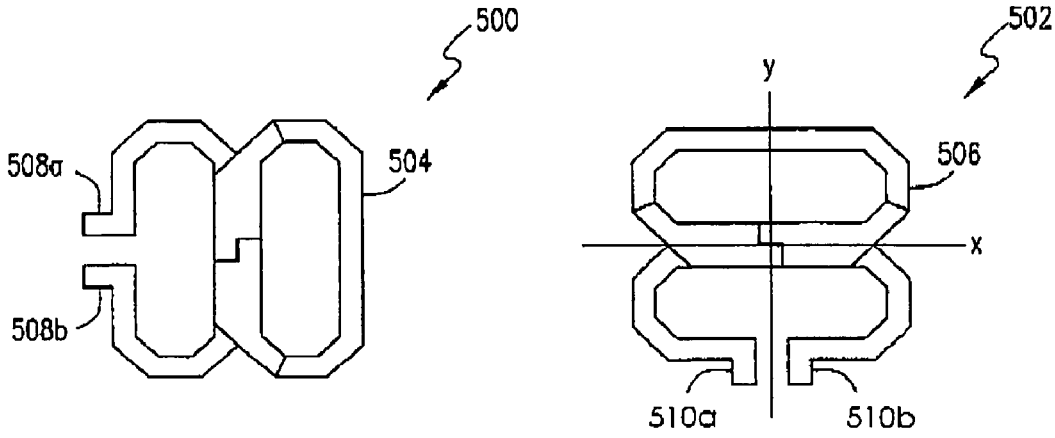
FIG. 5 illustrates an 8-shaped inductor arrangement wherein one inductor is rotated.

In some embodiments, it has been found that even greater isolation may be achieved by rotating one of the inductor coils, as shown in FIG. 5. Here, two inductors 500 and 502 having nearly identical 8-shaped inductor coils 504 and 506 have again been placed side-by-side. Their terminals are again labeled as 508*a* & 508*b* and 510*a* & 510*b*, respectively. However, one of the inductor coils, say, the inductor coil 504 on the left, has been rotated by 90 degrees to further reduce mutual EM coupling.

In addition to the above designs, other more complex inductor designs that are symmetrical in more than one dimension, for example, a four-leaf clover shape, may also be used. These complex inductor designs are useful because higher inductance values typically need to have more than one turn in order not to consume too much chip area. In addition, such complex inductor designs are often less sensitive to sub-optimal placement and orientation.

To determine the effectiveness of the above inductor designs in reducing mutual EM coupling, simulations were performed using the Momentum 2D EM Simulator™ from Agilent Technologies, with some simulations also repeated in FastHenry™ from the Computational Prototyping Group to verify the results. The simulations used a simple semiconductor substrate model that described the metal and dielectric layers on top of a typical semiconductor substrate. The four terminals of the two mutually coupled inductors were defined as the ports of a linear 4-port network (see FIG. 4). The interaction between the inductors in such a network may often be expressed using an s-parameter matrix. Those having ordinary skill in the art understand that s-parameter theory is a general technique used to describe how signals are reflected and transmitted in a network. The below s-parameter matrix S gives a substantially complete description of the network's behavior when it is connected to the surrounding components.

$$S = \begin{bmatrix} s_{11} & s_{12} & s_{13} & s_{14} \\ s_{21} & s_{22} & s_{23} & s_{24} \\ s_{31} & s_{32} & s_{33} & s_{34} \\ s_{41} & s_{42} & s_{43} & s_{44} \end{bmatrix} \quad (1)$$

However, the mutual coupling between the two inductors is often difficult to extract directly from the s-parameters where, as here, the network has four single-ended ports. For this type of analysis, it is sometimes more convenient to treat the two inductors as a differential 2-port network by transforming the single-ended s-parameter matrix into a mixed-mode s-parameter matrix $S^{mm}$:

$$S^{mm} = M \cdot S \cdot M^T \quad (2)$$

where M is the transformation of voltages and currents at the four single-ended ports to differential and common-mode voltages and currents at the two differential ports, and is given by:

$$M = \frac{1}{\sqrt{2}} \cdot \begin{bmatrix} 1 & -1 & 0 & 0 \\ 0 & 0 & 1 & -1 \\ 1 & 1 & 0 & 0 \\ 0 & 0 & 1 & 1 \end{bmatrix} \quad (3)$$

and $M^T$ is the transposed version of the original matrix M (i.e., with the rows and columns exchanged). For more information regarding this transformation, the reader is referred to David E Bockelman et al., *Combined Differential and Common-Mode Scattering Parameters: Theory and Simulation*, IEEE Trans. on Microwave Theory and Techniques, vol. MTT-43, pp. 1530–1539, July 1995. The results of the transformation is:

$$S^{mm} = \begin{bmatrix} \begin{bmatrix} s_{d1d1} & s_{d1d2} \\ s_{d2d1} & s_{d2d2} \end{bmatrix} & \begin{bmatrix} s_{d1c1} & s_{d1c2} \\ s_{d2c1} & s_{d2c2} \end{bmatrix} \\ \begin{bmatrix} s_{c1d1} & s_{c1d2} \\ s_{c2d1} & s_{c2d2} \end{bmatrix} & \begin{bmatrix} s_{c1c1} & s_{c1c2} \\ s_{c2c1} & s_{c2c2} \end{bmatrix} \end{bmatrix} \quad (4)$$

As can be seen, the upper left 2-by-2 sub-matrix contains the purely differential 2-port s-parameters, while the other sub-matrices contain the common-mode behavior. The voltage transfer gain $G_{vdd}$ was then calculated using standard 2-port s-parameter formulas, for example:

$$G_{vdd} = \text{real}\left(\frac{s_{d2d1}}{1 + s_{d1d1}}\right) \quad (5)$$

This theoretical gain parameter $G_{vdd}$ extracted from the 4-port s-parameter simulation results was then used to compare the mutual coupling between different combinations of inductor layouts.

Using the above mixed-mode s-parameters, the differential voltage gain $G_{vdd}$ from the ports of the first inductor to the ports of the second inductor was calculated at 3.7 GHz. The corresponding coupling coefficient was then estimated based on s-parameter simulations on a test circuit with two coupled inductors. Table 1 shows a summary of the simulation results for the mutual coupling between different coil shapes and orientations for two inductors at a center distance of 1 mm. In Table 1, the "notation 8_shape__90" represents a figure-8 shaped inductor that has been rotated 90 degrees and the notation "8_shape__−90" represents a figure-8 shaped inductor that has been rotated by −90 degrees, "Q1" is the Q-factor for the Inductor 1, "Att" is the attenuation of the mutual EM coupling between the two inductors, and k is the estimated coupling coefficient.

TABLE 1

| Inductor 1 | Inductor 2 | L1 [nH] | Q1 | Gvdd [dB] | Att [dB] | K |
|---|---|---|---|---|---|---|
| O-shape | O-shape | 0.841 | 16.93 | −54.0 | reference | 0.002077 |
| 8-shape | O-shape | 1.216 | 15.20 | −75.6 | 21.6 | 0.000173 |
| 8-shape_90 | O-shape | 1.218 | 15.63 | −74.9 | 20.9 | 0.000187 |
| 8-shape | 8-shape | 1.216 | 15.84 | −86.5 | 32.5 | 0.000049 |
| 8-shape_90 | 8-shape | 1.216 | 15.19 | −89.7 | 35.7 | 0.000034 |
| 8-shape_90 | 8-shape_−90 | 1.217 | 15.69 | −92.8 | 38.8 | 0.000024 |

As can be seen, making one of the inductors 8-shaped was shown to reduce the mutual coupling by up to 20 dB. Making both of them 8-shaped was shown to improve the isolation by up to 30 dB. Making both connectors 8-shaped and rotating them by 90 degrees in opposite directions was shown to improve the isolation nearly 40 dB.

Figure 6:
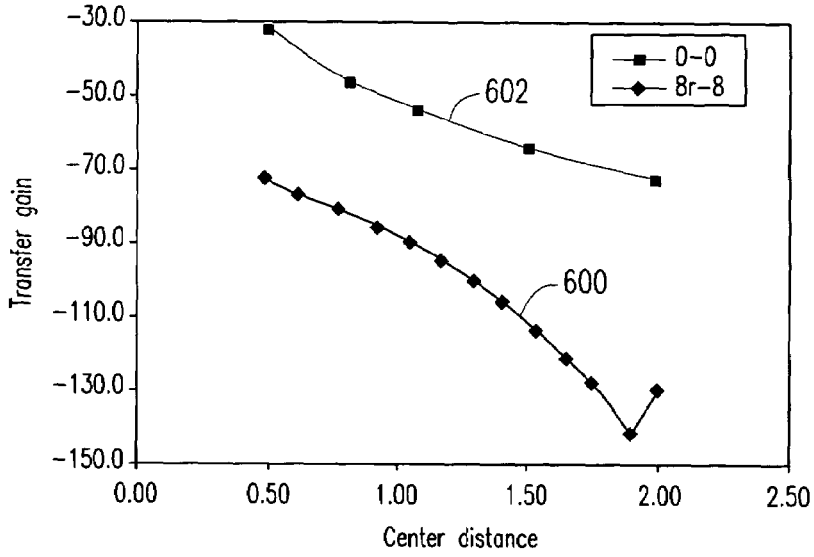
FIG. 6 illustrates the impact of distance on EM coupling using the 8-shaped inductor arrangement.

A second series of simulations was performed where the center distance between the coils was varied from 0.5 mm up to 2.0 mm for two 8-shaped inductors compared to two O-shaped inductors. The results are plotted in FIG. 6, where the vertical axis represents the differential transfer gain $G_{vdd}$ and the horizontal axis represents the distance between the centers of the two inductors in millimeters (mm). As can be seen, the 8-shaped inductors (plot 600) resulted in much lower mutual coupling relative to the O-shaped inductors (plot 602). In addition, the 8-shaped inductors show a degree of resonant behavior where the mutual coupling is very low at a certain distance (depending on the frequency). The "average" isolation improvement for the second series (ignoring the sharp minima near 2.0 mm) is between 30 and 40 dB.

Figure 7:
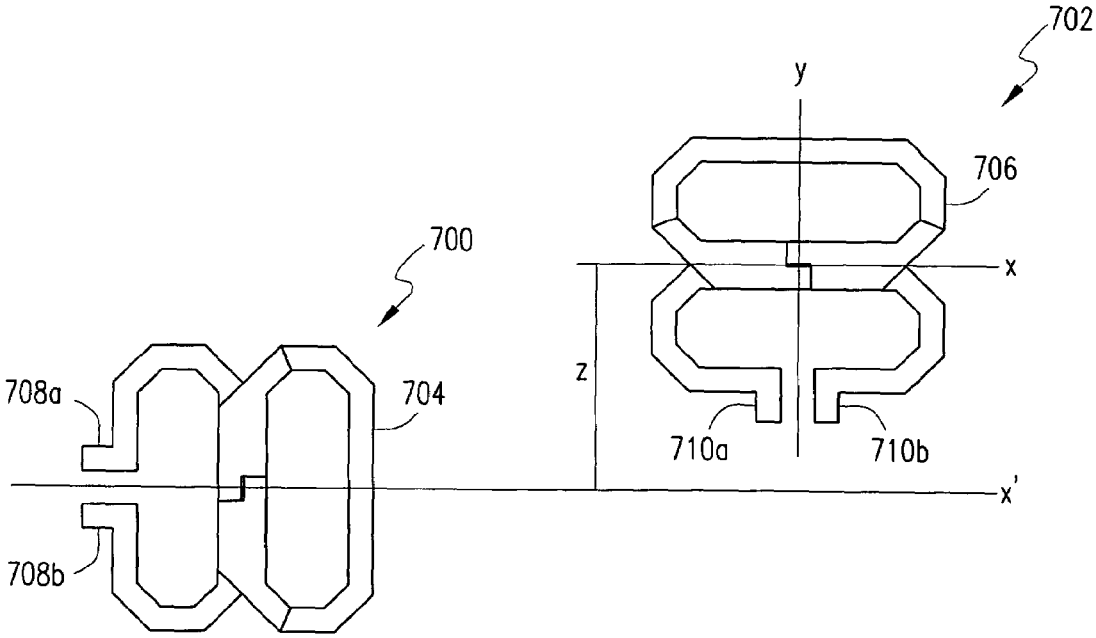
FIG. 7 illustrates an 8-shaped inductor arrangement wherein one inductor is offset from the other inductor.

Positioning of the inductors relative to each other may also affect the amount of mutual coupling. In order to get an understanding of how much the positioning of the inductors affects mutual coupling, additional simulations were done where one of the inductor coils was offset from the ideal symmetry axis by a varying amount. This is illustrated in FIG. 7, where two inductors 700 and 702 having nearly identical 8-shaped inductor coils 704 and 706 are shown. As can be seen, however, the inductor coil 704 on the left has been offset vertically from the ideal symmetry axis X by a certain distance Z to a new axis X'. The details of the simulation are shown in Table 2 below, where Deg is the degmdation in dB. With this arrangement, some degradation of the inductor isolation was observed, but even at a 1 mm offset, which corresponds to an orientation of 45 degrees, an improvement of about 30 dB in mutual coupling reduction is achieved for the 8-shaped inductor.

TABLE 2

| Offset [mm] | L1 [nH] | Q1 | Gvdd [dB] | Att [dB] | Deg [dB] | k estim |
|---|---|---|---|---|---|---|
| 0.0 | 1.216 | 15.19 | −89.7 | 35.7 | reference | 0.000034 |
| 0.1 | 1.216 | 15.19 | −85.3 | 31.3 | 4.4 | 0.000057 |
| 0.2 | 1.216 | 15.19 | −82.5 | 28.5 | 7.2 | 0.000078 |
| 0.3 | 1.216 | 15.19 | −81.0 | 27.0 | 8.7 | 0.000093 |
| 0.5 | 1.216 | 15.19 | −81.8 | 27.8 | 7.9 | 0.000085 |
| 0.7 | 1.216 | 15.19 | −85.8 | 31.8 | 3.9 | 0.000053 |
| 1.0 | 1.216 | 15.19 | −103.4 | 49.4 | −13.7 | 0.000007 |

To investigate the relationship between differential voltage gain $G_{vdd}$ and coupling coefficient k, s-parameter simulations of the two inductors were performed in Spectre™. Thereafter, an estimated coupling coefficient k was able to be calculated from Momentum 2D EM Simulator™ results and included in Table 1 and Table 2.

To verify the results of the coupling coefficient estimation, an alternative tool FastHenry™ was used to calculate k. The simulated results are plotted in FIG. 8. In FIG. 8 the horizontal axis again represents the distance between the centers of the inductors in mm, but the vertical axis now represents the coupling coefficient k, the bottom plot 800 represents the FastHenry™ results, and the top plot 802 represents the Momentum 2D EM Simulator™ results. The agreement between the two sets of results appears quite good for distances up to 1.5 mm, but some discrepancy may be noted at 2 mm. The most likely explanation for the discrepancy is that the Momentum 2D EM Simulator™ results are more reliable.

From the foregoing, it can be clearly seen that mutual coupling reduction is closely related to the symmetry of the inductor. Therefore, the layout of the rest of the VCO should be designed to minimize any additional inductor loops that may be created when the inductor is connected to the VCO components (e.g., varicaps and capacitive switches), since the magnetic field from this additional loop will affect the balance between the up field components of opposite signs and reduce any canceling effect.

Figure 9:
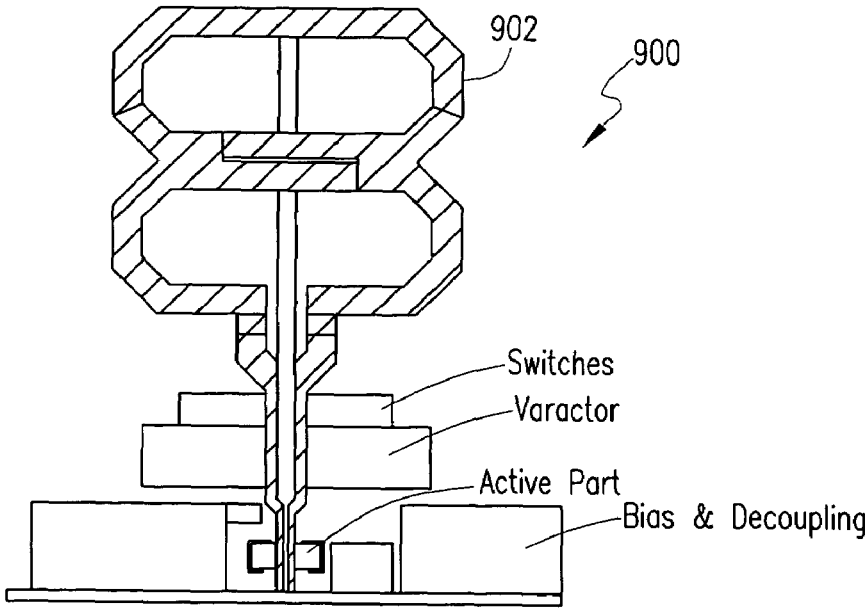
FIG. 9 illustrates a VCO layout wherein symmetry is retained.

FIG. 9 shows an exemplary layout for a typical 4 GHz VCO 900 with an 8-shaped inductor 902 that may be used to minimize any additional inductor loops. As can be seen, the layout for the resonator (e.g., switches, varactor) and active parts is substantially symmetrical around the vertical axis Y. The supply voltage (e.g., bias and decoupling) is also applied symmetrically, with the wires routed on top of each other so that they will not create an additional loop. Preferably, all capacitive resonator components are fully differential and have a symmetrical layout.

Figure 10:
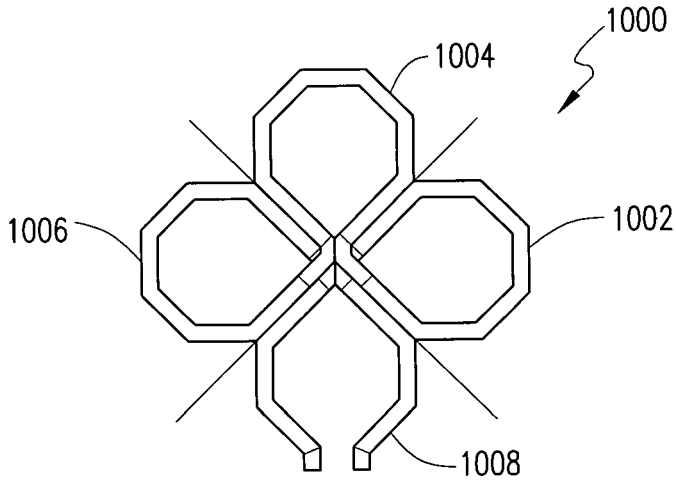
FIG. 10 illustrates a four-leaf clover shaped inductor.

As alluded to above, more complex inductor designs that are symmetrical in more than one dimension, for example, a four-leaf clover shape design, may also be used. In general, by increasing the number of loops from two to four, the canceling effect may be improved further in some directions and for some distances. This is because, in general (and at least for the 8-shaped inductors), the isolation between inductors is dependent on the relative placement of the coils. FIG. 10 illustrates an example of a four-leaf clover-shaped inductor 1000. The four loops 1002, 1004, 1006, and 1008 of the inductor 1000 are connected in such a way that the magnetic field emanating from any two adjacent loops have opposite directions and tend to cancel one another. Thus, the cancellation of the different magnetic field components is less dependent, for example, on the direction of the second inductor coil where two four-leaf clover-shaped inductors are present on the same chip.

Figure 11:
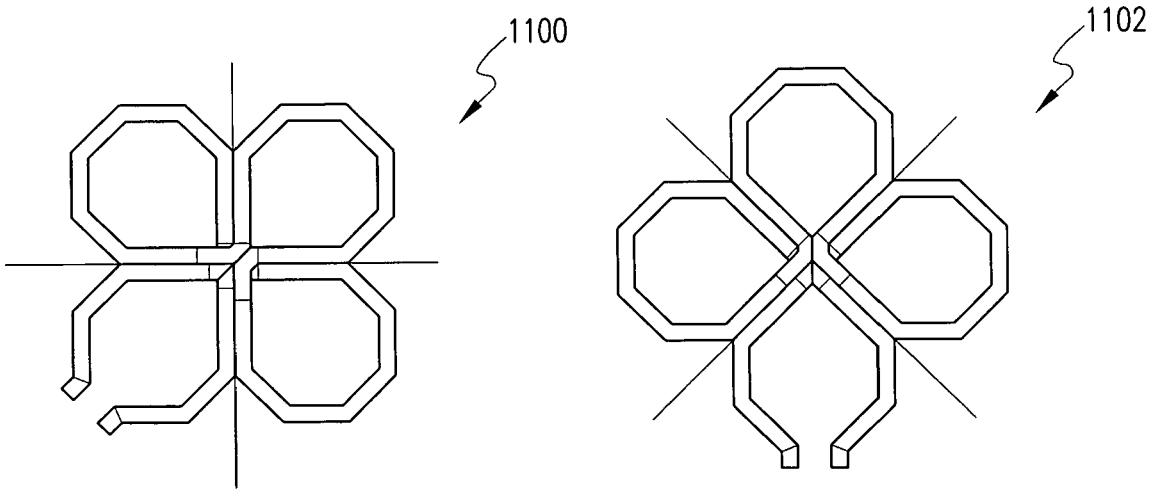
FIG. 11 illustrates a four-leaf clover shaped inductor arrangement.

Furthermore, as shown in FIG. 11, a configuration where one of the inductors (e. g. , inductor 1100) is rotated 45 degrees relative to the other inductor (e.g., inductor 1102)

has been observed to have even lower EM coupling between the two inductors 1100 and 1102.

Figure 12:
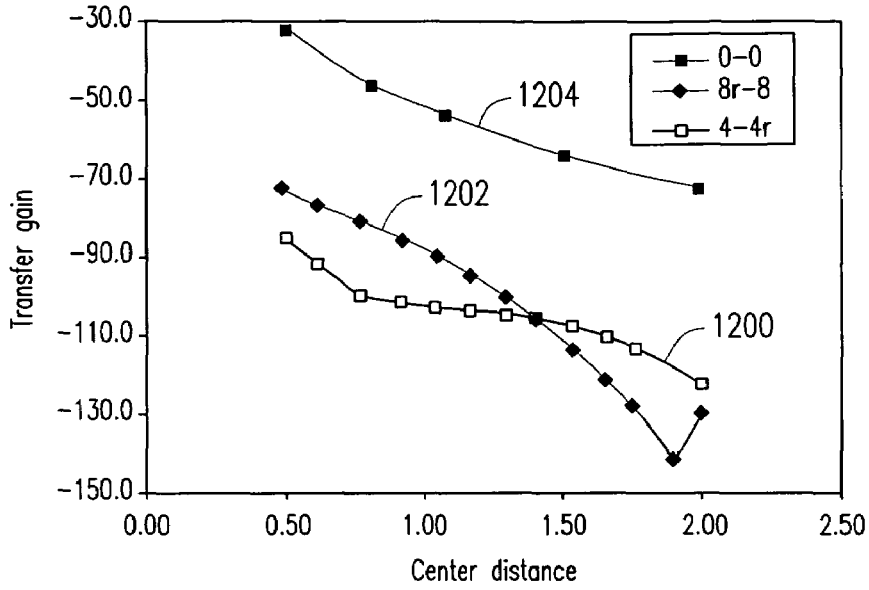
FIG. 12 illustrates the impact of distance on EM coupling using the four-leaf clover shaped inductor arrangement.

The differential transfer gain $G_{vdd}$ is plotted in FIG. 12 for two four-leaf clover shaped inductor arrangement (plot 1200) as a function of center distance together with the performance of two 8-shaped inductors (plot 1202) and two O-shaped inductors (plot 1204). One of the four-leaf clover shaped inductors has been rotated by about 45 degrees (indicated by the "r") and likewise one of the 8-shaped inductors has been rotated by about 90 degrees (again indicated by the "r"). The vertical axis of the chart represents the differential transfer gain $G_{vdd}$ and the horizontal axis represents the center distance. As can be seen, the isolation for the two four-leaf clover shaped inductor arrangement is nearly 10 dB better than the 8-shaped inductor arrangement for distances below 1 mm and show no resonant behavior at larger distances.

The improvement in the directional behavior of the four-leaf clover shaped inductor arrangement is shown in Table 3. As can be seen, there is no degradation in isolation when moving away from the symmetry axis, only a smaller improvement due to the increasing distance. However, due to the more complex wire layout, resulting in less inductance per length of wire, the Q-factor is slightly lower compared to the 8-shaped inductor arrangement.

TABLE 3

| Offset [mm] | L1 [nH] | Q1 | Gvdd [dB] | Att [dB] | Deg [dB] | k estim |
|---|---|---|---|---|---|---|
| 0.0 | 1.300 | 13.09 | −92.5 | 38.5 | reference | 0.000025 |
| 0.1 | 1.300 | 13.09 | −92.9 | 38.9 | −0.4 | 0.000024 |
| 0.2 | 1.300 | 13.09 | −92.9 | 38.9 | −0.4 | 0.000024 |
| 0.3 | 1.300 | 13.09 | −93.4 | 39.4 | −0.9 | 0.000022 |
| 0.5 | 1.300 | 13.09 | −94.1 | 40.1 | −1.6 | 0.000021 |
| 0.7 | 1.300 | 13.09 | −94.9 | 40.9 | −2.4 | 0.000019 |
| 1.0 | 1.300 | 13.09 | −97.1 | 43.1 | −4.6 | 0.000015 |

Figure 13:
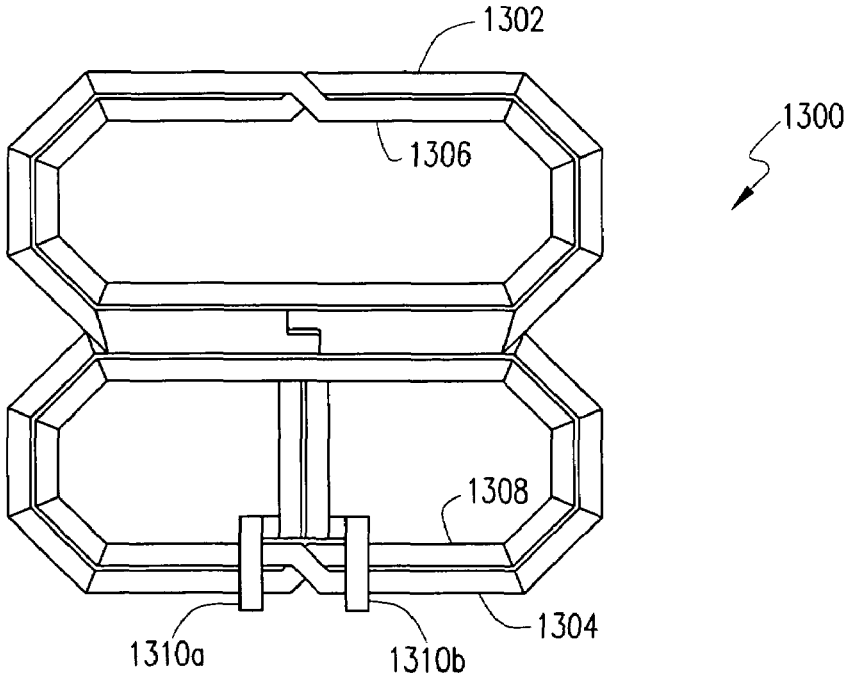
FIG. 13 illustrates a two-turn 8-shaped inductor.

In applications where higher inductance values are needed, it is possible to use inductor coils with more than one turn, since single turn designs tend to take up too much chip area. An example of a two-turn 8-shaped inductor 1300 is shown in FIG. 13. As can be seen, the two-turn 8-shaped inductor 1300 is essentially similar to the 8-shaped inductor 200 of FIG. 2, except that the two outer loops 1302 and 1304 of the inductor 1300 each turn into an inner loop 1306 and 1308, respectively. The terminals 1310*a* and 1310*b* of the inductor 1300 are then connected to the lower inner loop 1308. Such a two-turn inductor 1300 may provide a higher inductance value without taking up too much chip area, while also reducing the Q-factor. In the embodiment shown here, the Q-factor maybe reduced from approximately 15 to 12.5 at 4 GHz.

Although a two-turn 8-shaped inductor has been shown, those of ordinary skill and they are will understand that other configurations may also be used, such as a two-turn four-leaf clover shaped inductor, provided that near symmetry can be maintained given the crossing of the inner and outer loops and positioning requirements of the terminals. Other symmetrical shapes besides those described thus far may also show the same or even better coupling reduction if a satisfactory balance between parameters such as Q-factor, coil size, and coupling coefficient can be reached.

While the present invention has been described with reference to one or more particular ilustrative embodiments, those skilled in the art will recognize that many changes may be made thereto without departing from the spirit and scope of the present invention. For example, although only reduction in electro-magnetic coupling has been described in the foregoing, other coupling mechanisms via the substrate or supply lines as well as the effects of components placed between the two VCOs can have an important influence on the maximum achievable isolation. Therefore, each of the foregoing embodiments and variations thereof is contemplated as falling within the spirit and scope of the claimed invention, which is set forth in the following claims.

What is claimed is:

1. An inductor layout having reduced mutual electromagnetic coupling, comprising:

a first inductor having a reduced far field, said first inductor comprising:

a first loop having a shape that is substantially symmetrical about a first predefined axis;

a second loop connected to the first loop, said second loop having a size and shape substantially identical to the first ioop, said second loop arranged such that a magnetic field emanating therefrom tends to cancel a magnetic field emanating from the first loop; and two closely spaced terminals connected to the first loop for supplying electrical current to the first and second loops while minimizing magnetic field contributions from the terminals; and a second inductor positioned at a predetermined distance from the first inductor, wherein a mutual electromagnetic coupling between the first inductor and the second inductor is reduced as a result of the first inductor having a reduced electromagnetic field.

2. The inductor layout according to claim 1, wherein said first inductor and said second inductor are formed on a single semiconductor die.

3. The inductor layout according to claim 1, wherein said first inductor and said second inductor are oriented in a same direction.

4. The inductor layout according to claim 1, wherein said first inductor and said second inductor are oriented in different directions.

5. The inductor layout according to claim 1, wherein said first inductor and said second inductor share a common axis.

6. The inductor layout according to claim 1, wherein said first inductor and said second inductor share no common axis.

7. The inductor layout according to claim 1, wherein the second inductor also includes two loops, and said first inductor and said second inductor are substantially 8-shaped.

8. The inductor layout according to claim 7, further comprising an inner loop within each of the two loops of said substantially 8-shaped first and second inductors.

9. The inductor layout according to claim 1, wherein said first inductor also includes a third loop connected to the second loop and a fourth loop connected to the third loop and to the first loop, wherein the first inductor is substantially four-leaf clover-shaped.

10. The inductor layout according to claim 1, wherein said first inductor and said second inductor are symmetrical about a second predefined axis.

11. A method of reducing mutual electromagnetic coupling between a first inductor and a second inductor on a semiconductor die, comprising:

forming the first inductor to reduce a far field, said step of forming the first inductor comprising:

forming a first loop having a shape that is substantially symmetrical about a first predefined axis;

forming a second loop having a size and shape substantially identical to the first loop;

orienting the second loop in relation to the first loop such that a magnetic field emanating from the second loop tends to cancel a magnetic field emanating from the first loop; and connecting two closely spaced terminals to the first loop for supplying electrical current to the first and second loops while minimizing magnetic field contributions from the terminals; and positioning a second inductor at a predetermined distance from the first inductor, wherein the mutual electromagnetic coupling between the first inductor and the second inductor is reduced as a result of the first inductor having a reduced electromagnetic field.

12. The method according to claim 11, wherein the step of forming the first inductor also includes:

forming a third ioop having a size and shape substantially identical to the first and second loops;

forming a fourth loop having a size and shape substantially identical to the first, second, and third loops; and orienting the first, second, third, and fourth loops to form a substantially four-leaf clover-shape.

13. The method according to claim 11, wherein the step of positioning the second inductor includes orienting said first inductor and said second inductor in a same direction.

14. The method according to claim 11, wherein the step of positioning the second inductor includes orienting said first inductor and said second inductor in different directions.

15. The method according to claim 11, wherein the step of positioning the second inductor includes placing said first inductor and said second inductor on a common axis that is shared by said first inductor and said second inductor.

16. The method according to claim 11, wherein the step of positioning the second inductor includes placing said first inductor and said second inductor so that they share no common axis.

17. The method according to claim 11, wherein the step of orienting the second loop in relation to the first loop includes placing the first and second loops in a substantially 8-shape.

18. The method according to claim 17, further comprising forming an inner loop within each of the two loops of said substantially 8-shaped first inductor.

19. The method according to claim 11, wherein the step of positioning the second inductor includes positioning said first inductor and said second inductor so that they are symmetrical about a second predefined axis.

20. An inductor having a reduced far field, comprising:

a first loop having a shape that is substantially symmetrical about a first predefined axis;

a second loop having a size and shape substantially identical to the first loop, said second loop arranged such that a magnetic field emanating therefrom tends to cancel a magnetic field emanating from said first loop; and two closely spaced terminals connected to the first loop for supplying electrical current to the first and second loops while minimizing magnetic field contributions from the terminals.

21. The inductor according to claim 20, wherein said first loop and said second loop are substantially symmetrical about a second predefined axis.

* * * * *

UNITED STATES PATENT AND TRADEMARK OFFICE

CERTIFICATE OF CORRECTION

PATENT NO. : 7,151,430 B2
APPLICATION NO. : 10/919130
DATED : December 19, 2006
INVENTOR(S) : Mattsson It is certified that error appears in the above-identified patent and that said Letters Patent is hereby corrected as shown below:

In Column 1, Line 9, after “bearing” insert -- Docket No. 53807-00113USPL --.

In Column 1, Line 13, delete “01” and insert -- Docket No. 53807-00113USPL.01 --, therefor.

In Column 7, Line 47, delete “degmdation” and insert -- degradation --, therefor.

In Column 9, Line 55, after “skill” delete “and they are”.

In Column 9, Line 65, delete “ilustrative” and insert -- illustrative --, therefor.

In Column 10, Line 19, in Claim 1, delete “ioop” and insert -- loop --, therefor.

In Column 11, Line 18, in Claim 12, delete “ioop” and insert -- loop --, therefor.

Signed and Sealed this

Eighteenth Day of December, 2007

JON W. DUDAS
*Director of the United States Patent and Trademark Office*